US011891860B2

(12) United States Patent
Ishizuka et al.

(10) Patent No.: US 11,891,860 B2
(45) Date of Patent: Feb. 6, 2024

(54) CASING PROTECTION BIT

(71) Applicant: METAL TOOL INC., Nagoya (JP)

(72) Inventors: Takemi Ishizuka, Nagoya (JP); Seiji Tanaka, Fukuoka (JP)

(73) Assignee: METAL TOOL INC.

( * ) Notice: Subject to any disclaimer, the term of this patent is extended or adjusted under 35 U.S.C. 154(b) by 82 days.

(21) Appl. No.: 17/496,150

(22) Filed: Oct. 7, 2021

(65) Prior Publication Data

US 2022/0106839 A1 Apr. 7, 2022

Related U.S. Application Data

(63) Continuation of application No. PCT/JP2020/014626, filed on Mar. 30, 2020.

(30) Foreign Application Priority Data

Apr. 8, 2019 (JP) ..... 2019-073281

(51) Int. Cl.
*E21B 10/42* (2006.01)
*E21B 7/20* (2006.01)
*E02D 7/22* (2006.01)

(52) U.S. Cl.
CPC ..... *E21B 10/42* (2013.01); *E02D 7/22* (2013.01); *E21B 7/20* (2013.01)

(58) Field of Classification Search
CPC ... E02D 11/00; E02D 7/22; E02D 7/28; E21B 10/42; E21B 7/20
See application file for complete search history.

(56) References Cited

U.S. PATENT DOCUMENTS 3,999,620 A * 12/1976 Watson ..... B23B 51/04 175/420.1
6,187,068 B1 * 2/2001 Frushour ..... E21B 10/5673 51/293

(Continued)

FOREIGN PATENT DOCUMENTS

CN 106481278 A 3/2017
CN 208203135 U 12/2018

(Continued)

OTHER PUBLICATIONS

Extended European Search Report dated Nov. 18, 2022 for Application No. 20786967.8 (10 pages).

(Continued)

*Primary Examiner* — Daniel P Stephenson
(74) *Attorney, Agent, or Firm* — Harness, Dickey & Pierce, P.L.C.

(57) ABSTRACT

Provided is a casing protection bit mounted on a casing tube in combination with a cutter bit to prevent abrasion or chipping of the cutter bit. The present invention is to provide a casing protection bit 1 to be mounted on a casing tube, the casing protection bit including: a base portion 2 that protrudes in an axial direction of the casing tube, the base portion having a mountain shape; and two leg portions 3 and 4 extending continuously with the base portion 2 and facing each other at a predetermined distance. In the casing protection bit cemented carbide tips 5*a* to 5*j* are disposed on all planes of the base portion 2 except for a plane from which the leg portions 3 and 4 extend.

5 Claims, 5 Drawing Sheets

(56) References Cited

U.S. PATENT DOCUMENTS

| | | | | |
|---|---|---|---|---|
| 11,441,361 | B2 * | 9/2022 | Ishizuka | E02D 7/22 |
| 2021/0254411 | A1 | 8/2021 | Ishizuka et al. | |
| 2022/0106839 | A1 * | 4/2022 | Ishizuka | E21B 7/20 |

FOREIGN PATENT DOCUMENTS

| | | | | |
|---|---|---|---|---|
| CN | 208564438 | U | | 3/2019 |
| JP | H03-290587 | A | | 12/1991 |
| JP | 18333978 | A | | 12/1996 |
| JP | H10-306674 | A | | 11/1998 |
| JP | 2002-322892 | A | | 11/2002 |
| JP | 2002371782 | A | | 12/2002 |
| JP | 2003-193795 | A | | 7/2003 |
| JP | 3100138 | U | * | 4/2004 |
| JP | 2008133599 | A | * | 6/2008 |
| JP | 2012-241459 | A | | 12/2012 |
| JP | 2013-147814 | A | | 8/2013 |
| JP | 2016-223196 | A | | 12/2016 |
| JP | 2018-135683 | A | | 8/2018 |
| JP | 6472150 | B1 | | 2/2019 |
| JP | 20202554 | A | | 1/2020 |
| JP | 2021038545 | A | * | 3/2021 |
| WO | 2020/004294 | A1 | | 1/2020 |

OTHER PUBLICATIONS

Office Action regarding Japanese Patent Application No. 2019-073281, dated Jun. 21, 2019.

International Search Report and Written Opinion (with translation) regarding International Application No. PCT/JP2020/014626, dated Jun. 16, 2020.

Chinese Office Action (with English translation) for Application No. 202080027517.3 dated Jul. 12, 2022 (15 pages).

* cited by examiner

[FIG.1]
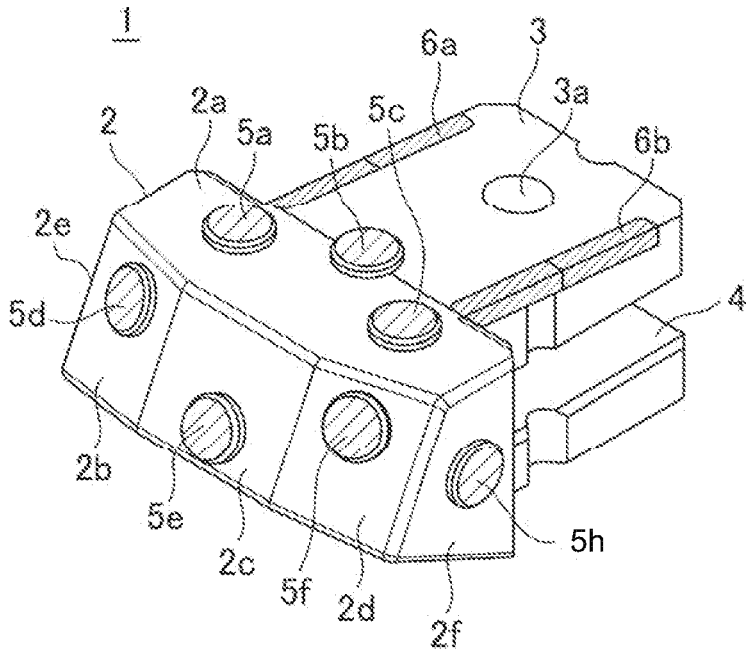

[FIG. 2]
(a)
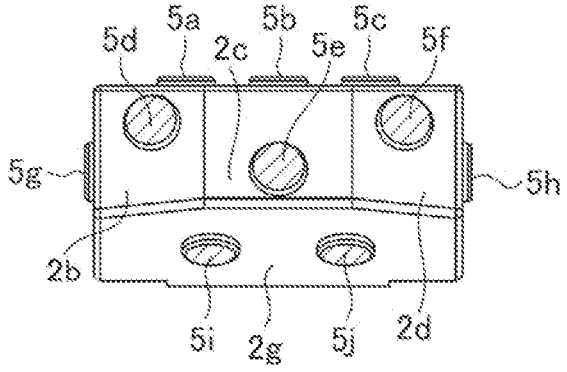
(b)
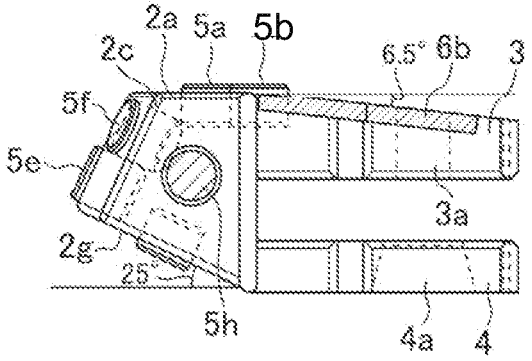
(c)
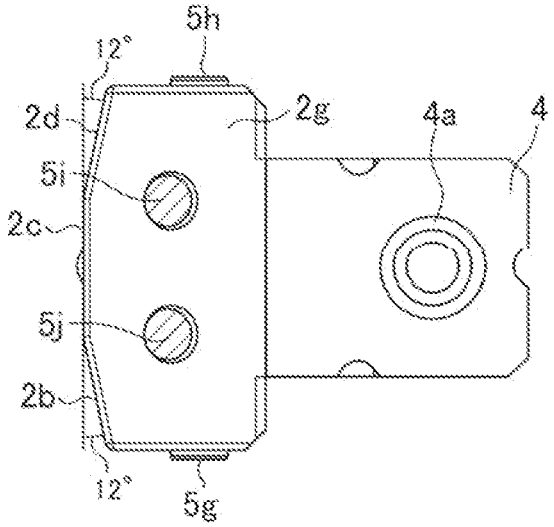

[FIG. 3]
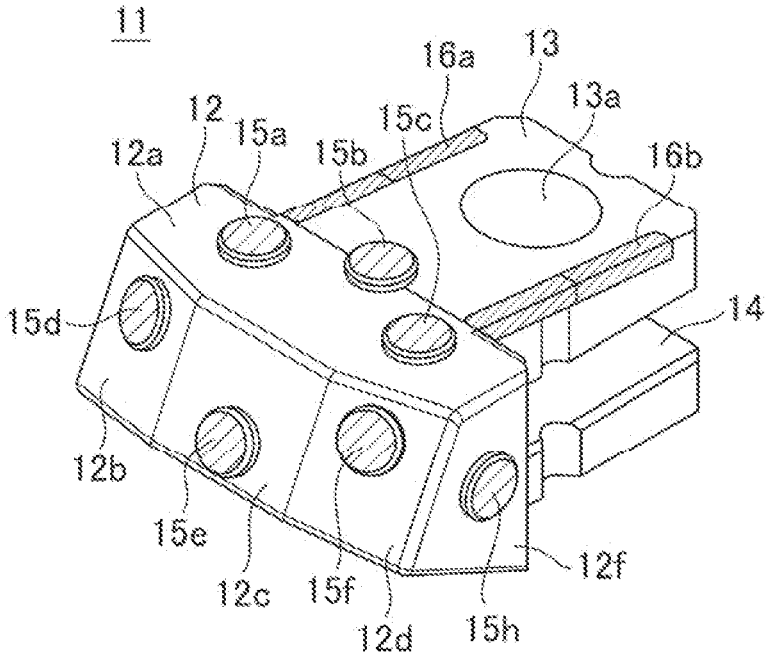

[FIG. 4]
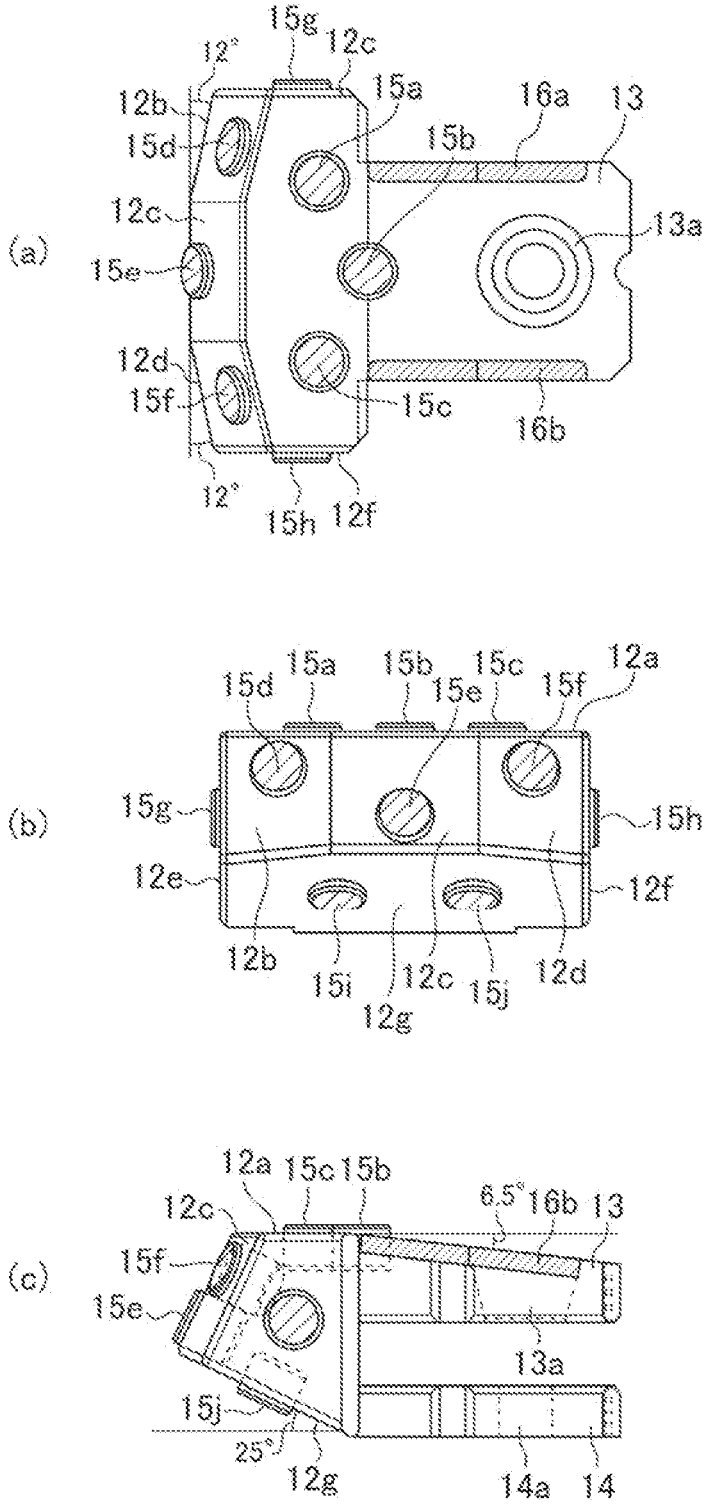

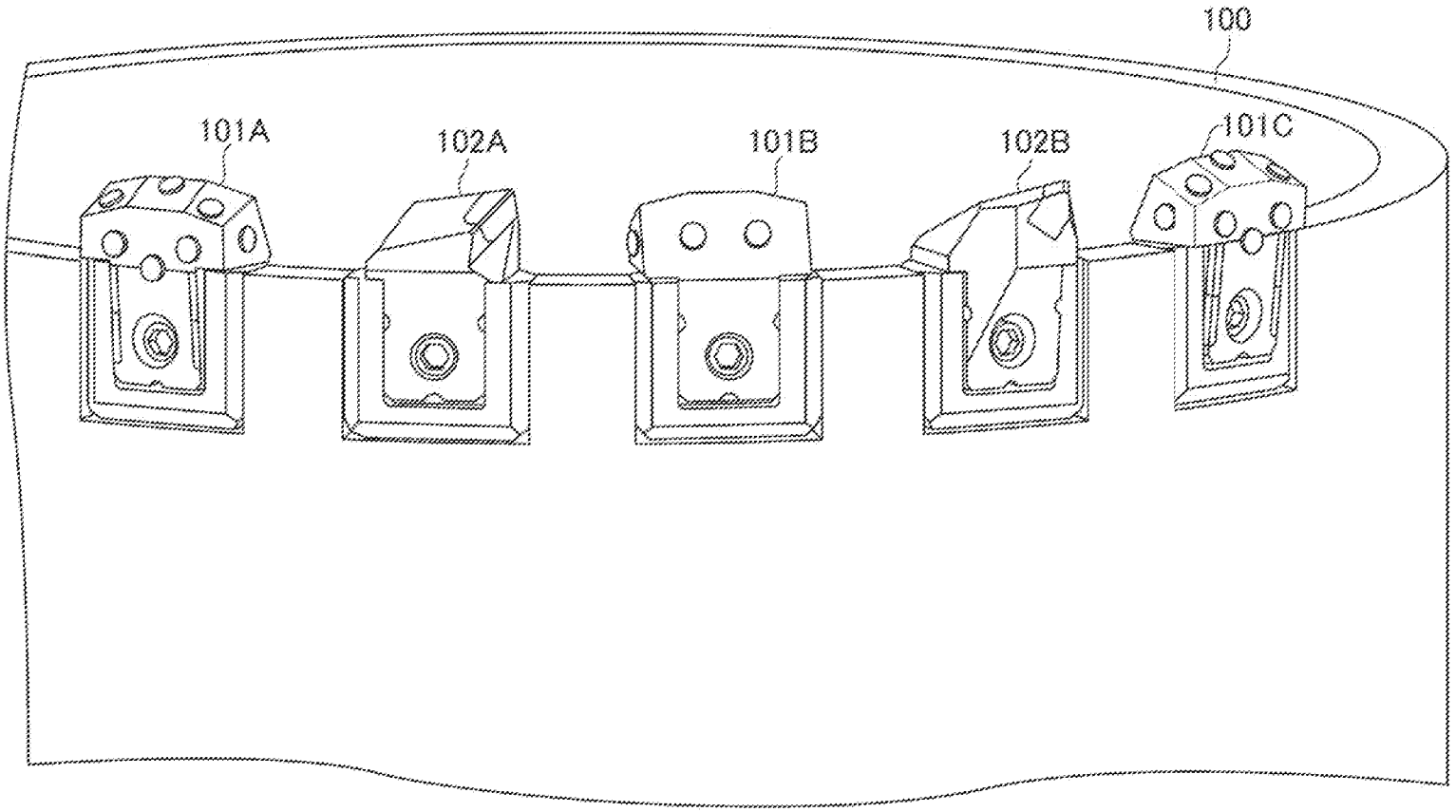
[FIG. 5]

CASING PROTECTION BIT

CROSS REFERENCE TO RELATED APPLICATIONS

The present application is a continuation application of International Patent Application No. PCT/JP2020/014626 filed on Mar. 30, 2020, which claims priority to Japanese Patent Application No. 2019-073281, filed on Apr. 8, 2019. The contents of the above applications are incorporated herein by reference in their entirety.

TECHNICAL FIELD

The present invention relates to a casing protection bit to be mounted on a casing tube.

BACKGROUND ART

Conventionally, as a pile constructing method of placing concrete in the earth to form a pile, a so-called all-casing method of inserting a casing tube into the earth by pressing, performing excavation and earth-sand removal with a grab bucket while protecting a hole wall, and placing concrete in a hole formed through excavation has been typically known. In the all-casing method, inner-blade, middle-blade, and outer-blade cutter bits are attached to a front end of a casing tube through bit attachment holders, and the casing tube is rotated to perform excavation by the cutter bits.

Here, an example of such a cutter bit includes a cutter bit for excavation attached to a front end portion of a casing pipe in a circumferential direction of the casing pipe, the cutter bit including a head portion in which a blade body of a cemented carbide tip is fixed to the front end portion and a leg portion provided with fixing means for a holder fixed to the casing pipe, the blade body of the cemented carbide tip being formed with a linear ridge portion, which slides and moves on an inner wall surface of a hole with a predetermined length from the front end portion toward the leg portion side during excavation, on an outer peripheral part thereof (for example, see Patent Literature 1).

CITATION LIST

Patent Literature

Patent Literature 1

Japanese Patent Laid-Open No. 2016-223196

SUMMARY OF INVENTION

Technical Problem

However, Patent Literature 1 merely discloses a cutter bit for the purpose of excavation, but does not disclose a casing protection bit mounted on a casing tube in combination with a cutter bit to prevent abrasion or chipping of the cutter bit, abrasion of the casing tube, and abrasion of a holder. There is no prior art related to such a casing protection bit.

The present invention has been made in view of such problems, and is aimed to provide a casing protection bit mounted on a casing tube in combination with a cutter bit to prevent abrasion or chipping of the cutter bit, abrasion of the casing tube, and abrasion of a holder.

Solution to Problem

To solve the above-described problem, a casing protection bit according to a first aspect of the present invention is a casing protection bit to be mounted on a casing tube, the casing protection bit including: a base portion including a front end that protrudes in an axial direction of the casing tube; and two leg portions extending continuously with the base portion and facing each other at a predetermined distance, wherein the base portion includes a flat surface part that is continuous in parallel with planes of the leg portions, a first inclined part that is inclined from the flat surface part toward the front end side in an axial direction of the casing tube, side surface parts each of which is continuous from the flat surface part and the first inclined part, and a second inclined part that is inclined from the first inclined part toward the leg portions side in the axial direction of the casing tube, cemented carbide tips are disposed on the flat surface part, the first inclined part, the side surface parts, and the second inclined part, and long-shaped cemented carbide tips are disposed on both edges of the leg portion continuous from the flat surface part, the edges extending in the axial direction of the casing tube.

A casing protection bit according to a second aspect is configured such that, in the first aspect, the first inclined part includes first to third parts, and the first part is inclined with respect to a plane of the second part at a predetermined angle in the axial direction of the casing tube, and the third part is inclined with respect to the plane of the second part at a predetermined angle in the axial direction of the casing tube.

A casing protection bit according to a third aspect of the present invention is configured such that, in the second aspect, different materials of cemented carbide tips are used in any combination as the cemented carbide tips disposed on the flat surface part, the first inclined part, the side surface parts, and the second inclined part.

A casing protection bit according to a fourth aspect of the present invention is a casing protection bit to be mounted on a casing tube, the casing protection bit including: a base portion that protrudes in an axial direction of the casing tube, the base portion having a mountain shape; and two leg portions extending continuously with the base portion and facing each other at a predetermined distance, wherein cemented carbide tips are disposed on all planes of the base portion except for a plane from which the leg portions extend.

A casing protection bit according to a fifth aspect of the present invention is a casing protection bit to be mounted on a casing tube, the casing protection bit including: a base portion including a front end that protrudes in an axial direction of the casing tube; and two leg portions extending continuously with the base portion and facing each other at a predetermined distance, wherein the base portion includes a flat surface part that is continuous in parallel with planes of the leg portions, a first inclined part that is inclined from the flat surface part toward the front end side in an axial direction of the casing tube, side surface parts each of which is continuous from the flat surface part and the first inclined part, and a second inclined part that is inclined from the first inclined part toward the leg portions side in the axial direction of the casing tube, and cemented carbide tips are disposed on the flat surface part, the first inclined part, the side surface parts, and the second inclined part.

A casing protection bit according to a sixth aspect of the present invention is configured such that, in the fifth aspect, long-shaped cemented carbide tips may be disposed on both edges of the leg portion continuous from the flat surface part, the edges extending in the axial direction of the casing tube.

A casing protection bit according to a seventh aspect of the present invention is configured such that, in the sixth aspect, the first inclined part may include first to third parts, the first part may be inclined with respect to a plane of the second part at a predetermined angle in the axial direction of the casing tube, and the third part may be inclined with respect to the plane of the second part at a predetermined angle in the axial direction of the casing tube.

A casing protection bit according to an eighth aspect of the present invention is configured such that, in the fifth to seventh aspects, different materials of cemented carbide tips may be used in any combination as the cemented carbide tips disposed on the flat surface part, the first inclined part, the side surface parts, and the second inclined part.

Advantageous Effects of Invention

According to the present invention, it is possible to provide a casing protection bit mounted on a casing pipe in combination with a cutter bit to prevent abrasion or chipping of the cutter bit, abrasion of the casing tube, and abrasion of a holder.

BRIEF DESCRIPTION OF DRAWINGS

FIG. 1 is a perspective view showing a configuration of a casing protection bit for an inner-blade according to a first embodiment of the present invention.

FIG. 2A is a configuration diagram of the casing protection bit for the inner-blade according to the first embodiment of the present invention.

FIG. 2B is a configuration diagram of the casing protection bit for the inner-blade according to the first embodiment of the present invention.

FIG. 2C is a configuration diagram of the casing protection bit for the inner-blade according to the first embodiment of the present invention.

FIG. 3 is a perspective view showing a configuration of a casing protection bit for an outer-blade according to a second embodiment of the present invention.

FIG. 4A is a configuration diagram of the casing protection bit for the outer-blade according to the second embodiment of the present invention.

FIG. 4B is a configuration diagram of the casing protection bit for the outer-blade according to the second embodiment of the present invention.

FIG. 4C is a configuration diagram of the casing protection bit for the outer-blade according to the second embodiment of the present invention.

FIG. 5 is a perspective view showing an aspect of attaching the casing protection bits according to the first and second embodiment of the present invention to the casing tube.

DESCRIPTION OF EMBODIMENTS

Embodiments of the present invention will be described below with reference to the drawings.

A casing protection bit according to embodiments of the present invention is used in a state of being mounted on a casing tube. When the casing protection bit is mounted on the casing tube in combination with a cutter bit, it is possible to prevent abrasion or chipping of the cutter bit, abrasion of the casing tube, and abrasion of a holder. In particular, it is possible to effectively prevent abrasion or chipping at a front end portion of the casing tube, that is, near a cutter bit mounting portion, for example.

Further, as will be described in detail below, according to the casing protection bit for the outer-blade, it is possible to prevent abrasion of the casing tube itself on the outside of a contact surface and abrasion of the holder itself, and according to the casing protection bit for the inner-blade, it is possible to prevent abrasion of the casing tube itself and abrasion of the holder itself. Hereinafter, a configuration and an operation of each of the casing protection bit for the outer-blade and the casing protection bit for the inner-blade will be described in detail.

First Embodiment

For a description, FIGS. 1 and 2(*a*) to 2(*c*) show a configuration of a casing protection bit for an inner-blade according to a first embodiment of the present invention. More specifically, FIG. 1 shows a perspective view of the casing protection bit, FIG. 2(*a*) shows a front view of the casing protection bit, FIG. 2(*b*) shows a side view of the casing protection bit, and FIG. 2(*c*) shows a plan view of the casing protection bit, and the description will be given.

As shown in these drawings, a casing protection bit 1 includes a base portion 2 and two leg portions 3 and 4 extending from the base portion 2. In the present embodiment, a side closer to the base portion 2 is also referred to as a front end of the casing protection bit 1, and a side closer to the leg portions 3 and 4 is also referred to as a mounting side onto a casing tube or a rear end of the casing protection bit 1.

The base portion 2 has a so-called mountain shape in which a top part protrudes toward the front end side of the casing protection bit 1 in an axial direction of the casing tube. More specifically, a flat surface part 2*a* of the base portion 2 of the casing protection bit 1 is parallel to a plane of the leg portions 3 and 4, and three inclined parts 2*b*, 2*c*, and 2*d* are inclined from the flat surface part 2*a* toward the front end side at a predetermined angle in the axial direction of the casing tube, and are continuous with each other. A left end of the inclined part 2*b* is continuous with a side surface part 2*e* when viewed from the front end side in the axial direction of the casing tube, and a right end of the inclined part 2*d* is continuous with a side surface part 2*f* when viewed from the front end side in the axial direction of the casing tube.

Then, the inclined parts 2*b*, 2*c*, and 2*d* of the base portion 2 are continuous with each other in this order in a horizontal direction, that is, in a circumferential direction of the casing tube when viewed from the front end side in the axial direction of the casing tube. In this example, the inclined part 2*b* is inclined with respect to the inclined part 2*c* at an angle of 12° in the circumferential direction of the casing tube, and the inclined part 2*d* is inclined with respect to the inclined part 2*c* at an angle of 12° in a circumferential direction (a direction opposite to the inclination direction of the inclined part 2*c*) of the casing tube of the inclined part 2*b*. Lower ends of the inclined parts 2*b*, 2*c*, and 2*d* of the base portion 2 are continuous with an inclined part 2*g*. The inclined part 2*g* is inclined with respect to a plane parallel to the flat surface part 2*a*, at an angle of 25°, toward a rear end side in the axial direction of the casing tube, that is, toward a mounting side of the casing protection bit 1 on the casing tube.

The leg portions 3 and 4 extend in a U-shape from the base portion 2 toward the rear end side in the axial direction of the casing tube at a predetermined distance from each other. Then, an upper surface of the leg portion 3, which is a side opposite to the plane facing the leg portion 4, is inclined toward the rear end side at an angle of 6.5° with respect to the plane facing the leg portion 4. In this way, when the leg portion 3 is provided with an inclination angle of 6.5°, an internal pressure and an external pressure of the casing tube can be reduced. The inclination angle is set to be 6.5° in consideration of the degree of protrusion from outer and inner plates of the casing tube and reduction of earth pressure on the casing tube. The leg portions 3 and 4 are provided with holes 3*a* and 4*a* used to mount the casing protection bit 1 on the casing tube with bolts or the like. Further, cemented carbide tips 6*a* and 6*b* are disposed on both edges of the leg portion 3 extending in the axial direction of the casing tube.

Cemented carbide tips 5*a*, 5*b*, and 5*c* are disposed on the flat surface part 2*a*. In this example, the cemented carbide tip 5*b* is disposed further on the rear end side of the casing protection bit 1 than a line segment connecting between the cemented carbide tips 5*a* and 5*c*, and a part of the cemented carbide tip 5*b* is disposed on the leg portion 3. Cemented carbide tips 5*d*, 5*e*, and 5*f* are disposed on the inclined parts 2*b*, 2*c*, and 2*d*, respectively. In this example, the cemented carbide tip 5*e* is disposed below a line segment connecting between the cemented carbide tips 5*d* and 5*f* in a radial direction of the casing tube in the drawing. Cemented carbide tips 5*g* and 5*h* are disposed on the side surface parts 2*e* and 2*f*, respectively. Two cemented carbide tips 5*i* and 5*j* are disposed on the inclined part 2*g*. As described above, in this example, the cemented carbide tips 5*a* to 5*j* are disposed on all the surfaces of the base portion 2.

According to these cemented carbide tips 5*a* to 5*j*, it is possible to prevent abrasion of the casing tube itself on the outside of a contact surface and abrasion of the holder. Further, materials and hardness of the plurality of cemented carbide tips can be freely combined as appropriate according to bit hardness and the ground (or an obstacle) which is an excavation target. For example, in the casing protection bit 1 according to the present embodiment, it is possible to use five materials of cemented carbide tips at maximum in any combination and to effectively prevent chipping of the casing tube, chipping of the holder, and the like, during excavation of a wide range of excavation targets.

The base portion 2 of the casing protection bit 1 has bilateral symmetry with a line segment, as a symmetrical axis, passing through a center of the flat surface part 2*a* in the axial direction of the casing tube. In this way, protection performance is enhanced by the bilateral symmetry, the inclination angles of the inclined parts 2*b* to 2*d* and 2*g* provided on the respective surfaces, and the cemented carbide bits disposed at predetermined intervals on the respective surfaces.

Further, since contact surface angles of the inclined parts 2*b* and 2*d* in excavation are set to 12°, which is a large contact surface angle with a wide angle, it is possible to prevent chipping of the cemented carbide tips disposed on the inclined parts 2*b*, 2*c*, and 2*d*. As for the contact surfaces, the flat surface part 2*a* serves as an inner contact surface, and the inclined part 2*g* plays a role of reducing excavation earth pressure or impact and withstand-pressure of obstacles such as concrete, steel bars, or steel frames.

As for materials, the leg portions 3 and 4 can be formed using SCM440 (chromium/molybdenum steel) or the like as a base material, and the cemented carbide tips 5*a* to 5*j* can be formed using E3 (material name: MG30), E4 (material name: MG40), E5 (material name: MG50), E6 (material name: MG60), or the like in JIS classification codes, or G4 (CIS material code: VC-40), G5 (CIS material code: VC-50), or the like in CIS standards.

Second Embodiment

For a description, FIGS. 3 and 4(*a*) to 4(*c*) show a configuration of a casing protection bit for an outer-blade according to a first embodiment of the present invention. More specifically, FIG. 3 shows a perspective view of the casing protection bit, FIG. 4(*a*) shows a plan view of the casing protection bit, FIG. 4(*b*) shows a front view of the casing protection bit, and FIG. 4(*c*) shows a side view of the casing protection bit, and the description will be given.

As shown in these drawings, a casing protection bit 11 includes a base portion 12 and two leg portions 13 and 14 extending from the base portion 12. In the second embodiment, a side closer to the base portion 12 is also referred to as a front end of the casing protection bit 11, and a side closer to the leg portions 13 and 14 is also referred to as a mounting side onto a casing tube or a rear end of the casing protection bit 11.

The base portion 12 has a so-called mountain shape in which a top part protrudes toward the front end side of the casing protection bit 11 in an axial direction of the casing tube. More specifically, a flat surface part 12*a* of the base portion 12 of the casing protection bit 11 is parallel to a plane of the leg portions 13 and 14, and three inclined parts 12*b*, 12*c*, and 12*d* are inclined from the flat surface part 12*a* toward the front end side at a predetermined angle in the axial direction of the casing tube, and are continuous with each other. A left end of the inclined part 12*b* is continuous with a side surface part 12*e* when viewed from the front end side in the axial direction of the casing tube, and a right end of the inclined part 12*d* is continuous with a side surface part 12*f* when viewed from the front end side in the axial direction of the casing tube.

The inclined parts 12*b*, 12*c*, and 12*d* of the base portion 12 are continuous with each other in this order in a horizontal direction, that is, in a circumferential direction of the casing tube when viewed from the front end side in the axial direction of the casing tube. In this example, the inclined part 12*b* is inclined with respect to the inclined part 12*c* at an angle of 12° in the circumferential direction of the casing tube, and the inclined part 2*d* is inclined with respect to the inclined part 12*c* at an angle of 12° in a circumferential direction (a direction opposite to the inclination direction of the inclined part 12*b*) of the casing tube. Lower ends of the inclined parts 12*b*, 12*c*, and 12*d* are continuous with an inclined part 12*g*. The inclined part 12*g* is inclined with respect to a plane parallel to the flat surface part 12*a*, at an angle of 25°, toward a rear end side in the axial direction of the casing tube, that is, toward a mounting side of the casing protection bit 1 on the casing tube.

The leg portions 13 and 14 extend in a U-shape from the base portion 12 toward the rear end side in the axial direction of the casing tube at a predetermined distance from each other. Then, an upper surface of the leg portion 13, which is a side opposite to the plane facing the leg portion 14, is inclined toward the rear end side at an angle of 6.5° with respect to the plane facing the leg portion 14. In this way, when the leg portion 13 is provided with an inclination angle of 6.5°, an internal pressure and an external pressure of the casing tube can be reduced. The inclination angle is set to be 6.5° in consideration of the degree of protrusion from outer and inner plates of the casing tube and reduction of earth pressure on the casing tube. The leg portions 13 and 14 are provided with holes 13*a* and 14*a* used to mount the casing protection bit 11 on the casing tube with bolts or the like. Further, cemented carbide tips 16*a* and 16*b* are disposed on both edges of the leg portion 13 extending in the axial direction of the casing tube. The cemented carbide tips 16*a* and 16*b* having a rectangular parallelepiped shape mainly play a role of preventing chipping and abrasion of the casing tube and the holder, but also play a role of protecting holder attachment portions of the cutter bits disposed backward and forward.

Cemented carbide tips 15*a*, 15*b*, and 15*c* are disposed on the flat surface part 12*a*. In the second embodiment, the cemented carbide tip 15*b* is disposed further on the rear end side of the casing protection bit 11 than a line segment connecting between the cemented carbide tips 15*a* and 15*c*, and a part of the cemented carbide tip 15*b* is disposed on the leg portion 13. Cemented carbide tips 15*d*, 15*e*, and 15*f* are disposed on the inclined parts 12*b*, 12*c*, and 12*d*, respectively. In the second embodiment, the cemented carbide tip 15*e* is disposed below a line segment connecting between the cemented carbide tips 15*d* and 15*f* in a radial direction of the casing tube in the drawing. Cemented carbide tips 15*g* and 15*h* are disposed on the side surface parts 12*e* and 12*f*, respectively. Two cemented carbide tips 15*i* and 15*j* are disposed on the inclined part 12*g*. In the second embodiment as described above, the cemented carbide tips 15*a* to 15*j* are disposed on all the surfaces of the base portion 12. The cylindrical cemented carbide tips 15*a* to 15*j* having a circular cross section are disposed to reduce an impact such that the cutter bits are not directly affected from the excavation target to be excavated by the cutter bits disposed backward and forward and not to obstruct the flow of the excavation target, and are disposed such that the excavation target does not directly affect the casing tube and the holder.

Accordingly, according to these cemented carbide tips 15*a* to 15*j*, it is possible to prevent abrasion of the casing tube itself on the outside of a contact surface and abrasion of the holder. Further, materials and hardness of the plurality of cemented carbide tips can be freely combined as appropriate according to bit hardness and the ground (or an obstacle) which is an excavation target. For example, in the casing protection bit 11 according to the second embodiment, it is possible to use five materials of cemented carbide tips at maximum in any combination and to effectively prevent chipping of the casing tube, chipping of the holder, and the like, during excavation of a wide range of excavation targets.

The base portion 12 of the casing protection bit 11 has bilateral symmetry with a line segment, as a symmetrical axis, passing through a center of the flat surface part 12*a* in the axial direction of the casing tube. In this way, protection performance is enhanced by the bilateral symmetry, the inclination angles of the inclined parts 12*b* to 12*d* and 12*g* provided on the respective surfaces, and the cemented carbide bits disposed at predetermined intervals on the respective surface.

Further, since contact surface angles of the inclined parts 12*b* and 12*d* in excavation are set to 12°, which is a large contact surface angle with a wide angle, it is possible to prevent chipping of the cemented carbide tips disposed on the inclined parts 12*b*, 12*c*, and 12*d*. As for the contact surfaces, the flat surface part 12*a* serves as an outer contact surface, and the inclined part 12*g* plays a role of reducing excavation earth pressure or impact and withstand-pressure of obstacles such as concrete, steel bars, or steel frames.

As for materials, the leg portions 13 and 14 can be formed using SCM440 (chromium/molybdenum steel) or the like as a base material, and the cemented carbide tips 5*a* to 5*j* can be formed using E3 (material name: MG30), E4 (material name: MG40), E5 (material name: MG50), E6 (material name: MG60), or the like in JIS classification codes, or G4 (CIS material code: VC-40), G5 (CIS material code: VC-50), or the like in CIS standards.

Here, for a description, FIG. 5 shows an example of attaching the casing protection bits according to the first and second embodiments of the present invention to the casing tube.

As shown in FIG. 5, in the holders provided at an end part of a casing tube 100 at equal intervals, a casing protection bit 101A for an outer-blade and a casing protection bit 101B for an inner-blade are mounted alternately with an inner-blade cutter bit 102A interposed therebetween. An outer-blade cutter bit 102B is also interposed between the casing protection bit 101B for the inner-blade and a casing protection bit 101C for an outer-blade. In other words, the casing protection bit for the outer-blade and the casing protection bit for the inner-blade are mounted alternately such that the cutter bits are interposed therebetween. The casing protection bit 102A for the outer-blade plays a role in preventing chipping and abrasion of an outer blade of the cutter bit, the casing protection bit 102B for the inner-blade plays a role in preventing chipping and abrasion of an inner blade of the cutter bit and chipping, and both of them play a role in preventing abrasion of the holders on which the cutter bits are mounted. In other words, with such a layout, it is possible to reduce damage to the casing tube, the holder, and the cutter bit during excavation, and to smoothen a flow of earth and sand or the like caused by the excavation.

As described above, according to the embodiments of the present invention, the casing protection bits mounted on the casing tube are provided. When the casing protection bit for the outer-blade and the casing protection bit for the inner-blade are alternately mounted on the-casing tube with the cutter bits interposed therebetween, it is possible to prevent the chipping and abrasion of the casing tube and the cutter bits and the chipping and abrasion of the holders, and to perform the excavation work smoothly.

Although the first and second embodiments of the present invention are described above, the present invention is not limited thereto, and may be variously modified and changed without departing from the scope of the invention.

For example, the casing protection bits according to the present embodiments is applicable to, for example, underground obstacle removal work, and can prevent abrasion or chipping of a casing tube, a holder, and a cutter bit in work of removing underground obstacles such as a reinforced concrete structure, a steel pipe sheet pile, and H-steel. In addition, the casing protection bits are also applicable to boulder layer excavation, and in this case, can prevent abrasion or chipping of a casing tube, a holder, and a cutter bit in excavation at a boulder layer of river stones and hard rocks.

REFERENCE SIGNS LIST

1 casing protection bit
2 base portion
2*a* flat surface part
2*b* to 2*d* inclined part
2*e*, 2*f* side surface part
2*g* inclined part
3 leg portion
3*a* hole
4 leg portion
4*a* hole
5*a* to 5*j* cemented carbide tip
6*a*, 6*b* cemented carbide tip
11 casing protection bit
12 base portion
12*a* flat surface part

12*b* to 12*d* inclined part
12*e*, 12*f* side surface part
12*g* inclined part
13 leg portion
13*a* hole
14 leg portion
14*a* hole
15*a* to 15*j* cemented carbide tip
16*a*, 16*b* cemented carbide tip

What is claimed is:

1. A casing protection bit to be mounted on a casing tube, the casing protection bit comprising:

a base portion including a front end that protrudes in an axial direction of the casing tube; and first and second leg portions extending continuously with the base portion and facing each other at a predetermined distance, wherein the base portion includes a flat surface part that is continuous to a plane of the first leg portion, a first inclined part that is inclined from the flat surface part toward the front end side in an axial direction of the casing tube, side surface parts each of which is continuous from the flat surface part and the first inclined part, and a second inclined part that is inclined from the first inclined part toward the first and the second leg portions side in the axial direction of the casing tube, cemented carbide tips are disposed on the flat surface part, the first inclined part, the side surface parts, and the second inclined part, and long-shaped cemented carbide tips are disposed on laterally opposed edges of the first leg portion, the edges extending in the axial direction of the casing tube.

2. The casing protection bit according to claim 1, wherein the first inclined part includes first, second and third parts, and a plane of the first part is inclined with respect to a plane of the second part at a predetermined angle toward the leg portion side in the axial direction of the casing tube, and the third part is inclined with respect to the plane of the second part at a predetermined angle in the axial direction of the casing tube.

3. The casing protection bit according to claim 2, wherein different materials of cemented carbide tips are used in any combination as the of the first leg, Carbide tips disposed on the flat surface part, the first inclined part, the side surface parts, and the second inclined part.

4. The casing protection bit according to claim 1 wherein the long-shaped cemented carbide bits extend the majority of the length of the laterally opposed edges of the first leg portion.

5. The casing protection bit according to claim 4 wherein at least one of the cemented carbide tips covers portions of the flat surface part of the base portion and portions of a top surface of the first leg.

* * * * *